United States Patent [19]

Nishimura et al.

[11] 4,216,251

[45] Aug. 5, 1980

[54] METHOD OF PRODUCING A LEATHER-LIKE SHEET MATERIAL HAVING A HIGH-QUALITY FEELING

[75] Inventors: Takeo Nishimura; Kazundo Akamata, both of Okayama, Japan

[73] Assignee: Kuraray Co., Ltd., Kurashiki, Japan

[21] Appl. No.: 934,894

[22] Filed: Aug. 18, 1978

[30] Foreign Application Priority Data

Sep. 5, 1977 [JP] Japan ..... 52/107116
Sep. 5, 1977 [JP] Japan ..... 52/107117

[51] Int. Cl.[2] ..... B29G 5/00; B29D 3/02; B29D 9/08

[52] U.S. Cl. ..... 427/370; 264/185; 264/137; 264/171; 264/257; 264/284; 264/347

[58] Field of Search ..... 264/48, 42, 45.1, 45.8, 264/46.4, 137, 284, 331, 135, 257, 347; 428/423, 425; 427/362, 276, 277, 278, 370

[56] References Cited

U.S. PATENT DOCUMENTS

| | | | |
|---|---|---|---|
| 2,859,482 | 11/1958 | Warren et al. | 264/237 |
| 3,196,062 | 7/1965 | Kristal | 264/284 |
| 3,565,981 | 2/1971 | Lauro | 264/46.4 |
| 3,841,897 | 10/1974 | Okazaki et al. | 428/425 |
| 3,922,402 | 11/1975 | Shimamura et al. | 428/425 |
| 3,974,320 | 8/1976 | Gerlach et al. | 428/425 |

*Primary Examiner*—W. E. Hoag
*Attorney, Agent, or Firm*—Barry Kramer

[57] ABSTRACT

A leather-like sheet material bearing a remarkable resemblance to high-quality leathers of natural origin, especially in respect of flatness, bending crimp, grain and feeling, is produced by providing a substrate consisting of a fibrous base material and a porous coating layer with a thin layer of a polymer, subjecting the surface to a specific heat treatment, providing the resulting material with another thin layer of a polymer, and, if desired, embossing the material.

12 Claims, No Drawings

METHOD OF PRODUCING A LEATHER-LIKE SHEET MATERIAL HAVING A HIGH-QUALITY FEELING

BACKGROUND OF THE INVENTION

1. Field of the Invention

This invention relates to a method of producing a leather-like sheet material with a deluxe feeling. More particularly, it relates to a method of producing a leather-like sheet material capable of presenting such bending crimp as can give an impression of superior quality, excellent in flatness and having a high-quality feeling. The method involves, in a specific order, application of polymer layers to a substrate consisting of a fibrous base material and a porous coating layer, specific surface heat treatment, and optional embossing.

2. Description of the Prior Art

Two methods are known for providing the surface of a leather-like sheet material with an rugged pattern. One of the methods employs a supporting sheet such as a mold releasing paper or a polyethylene sheet, which has a required surface pattern, while the other comprises embossing the surface of the substrate by means of an embossing plate or an embossing roll following the preparation of the substrate. The former method is generally applied to low grade synthetic leathers, that is, leather-like sheet materials obtained by merely coating a substrate web or fabric with vinyl chloride polymer paste followed by drying. Although the reproducibility of the pattern of the support such as a mold releasing paper is good, incompleteness of the surface pattern of the supporting sheet itself renders the appearance, including the pattern and gloss of the leather-like sheet surface, evidently artificial and thus gives an impression that the resulting leather-like sheet material is a low-grade one. On the other hand, the latter method is generally used for synthetic leathers resembling natural leathers in structure in that a porous, elastic polymer layer is formed on the surface of a fibrous substrate material. By this method, the depth of the surface pattern can be varied at will by suitably adjusting the embossing conditions, and therefore a surface pattern closely resembling the grain of a natural leather can be obtained by selecting appropriate embossing conditions, said surface pattern appearing far less artificial than that produced by the former method.

The latter method, however, is not very suitable for the production of leather-like sheet materials which have such distinct and shallow grains as are present on the surface of a high-quality leather of natural origin, because, if the embossing conditions are not sufficient, the unevenness originating from that of the substrate surface, such as the unevenness due to fibers in the fibrous base material, due to the resin used as a binder for fibers, or due to pores in the porous coating layer, appears on the product surface even after the embossing. Under strong embossing conditions attained by adjusting temperature, pressure, duration and other parameters, a leather-like sheet material with vivid, shallow grains may be produced. In this case, however, another disadvantage is that the bending crimp of the sheet material, that is the crimp formed on the surface of the bent area when the sheet material is bent, appears too artificial, suggesting poor quality.

The specification of Japanese Utility Model Publication No. Sho-48-14671 discloses that, if an embossing apparatus the pressure part of which is maintained at a temperature around the softening point of the thermoplastic polymer to be used and the peeling part of which is cooled to a temperature at which the said thermoplastic polymer has a good dimension stability is used for embossing a sheet material having a surface layer consisting of a thermoplastic polymer such as polyurethane, poly(vinyl chloride) or polyamide, the sheet material can be peeled off from the embossing surface without strain on the sheet material; hence the sheet surface cannot be damaged, and consequently beautiful embossed patterns are produced. In addition, Japanese Patent Application Published under No. Sho-49-108204 discloses that a leather-like sheet material excellent in respect to bending crimp, surface luster and other properties and having a beautiful, embossed pattern is produced by applying a solution or suspension of a macromolecular substance to the surface of a porous sheet material, bringing the surface into close contact with a heated, mirror-smooth drum surface, then cooling the drum, peeling off the sheet material from the drum surface, and further embossing the sheet surface. These methods indeed improve the bending crimp and the embossing effect to a considerable extent, as described in the specifications. The bending crimp, however, is still far from that found with high-quality leathers of natural origin. Moreover, it is a great disadvantage that even and uniform embossing of the leather-like sheet surface is hard to achieve, for instance.

As a result, under the present conditions, there is a great difference in appearance between synthetic leathers provided with shallow grains by embossing, especially the ones with a mirror-smooth surface or with a pattern less than 50 microns deep, and natural leather, and the former are regarded as cheaper articles.

SUMMARY OF THE INVENTION

A primary object of the invention is to provide a leatherlike sheet material capable of presenting the same bending crimp suggestive of a high quality as in the case of highquality leathers of natural origin as well as provided with distinct, shallow grains even by shallow embossing. Another object of the invention is to provide a leather-like sheet material having a high-quality feeling, excellent in surface flatness, showing a surface pattern seeming inartificial in case the surface is provided with a pattern, and very good in appearance. A further object of the invention is to provide a method of producing such leather-like sheet material, wherein adjustment of color and luster of the sheet material can easily be made, while achieving the above objects.

These objects are accomplished by providing a substrate having a porous coating layer with a thin layer of a polymer, subjecting the surface of the substrate to a specific treatment for smoothening and thermal setting, providing the substrate with another thin layer of a polymer, and if desired, embossing the surface.

Thus, the invention consists of a method for producing a leather-like sheet material which comprises providing a substrate having a porous coating layer with a nonporous layer A of a polymer, pressing the substrate against a smooth surface at a temperature of 120° to 180° C. with the layer A in contact with said smooth surface, the temperature of said smooth surface being so controlled that it lowers gradually from the point of pressing to the point of peeling off, the temperature at the point of peeling off being in the range of 30° to 120° C.

and the temperature difference between the point of pressing and the point of peeling off being at least 20° C., subjecting the substrate surface continuously to smoothening and thermal setting under said temperature conditions, peeling off the substrate from said smooth surface, providing the substrate with a nonporous layer B of a polymer, and, if desired, embossing the surface of the substrate.

DETAILED DESCRIPTION OF THE INVENTION

In accordance with the present invention, the substrate consists of a fibrous base material and a porous coating layer of a polymer.

The fibrous base material may be a sheet composed mainly of fibers, such as nonwoven, woven or knitted fabric, and, if desired, may be impregnated with a polymer as a binder, the polymer being coagulated. The fiber to be used may be any of the ordinary fibers, more specifically, naturally occurring fibers such as cotton, hemp and wool, regenerated or semisynthetic fibers such as rayon and acetate, and synthetic fibers such as nylon, polyester, polyacrylonitrile and vinylon. In the case of synthetic fibers, single-component fibers as well as mixed spun or conjugated fibers can be used. In cases where mixed spun or conjugated fibers are used, it is preferred that at least one of the polymers of which the said fibers are composed should be removed by extraction at an arbitrarily chosen step, usually prior to or after the step of unifying the porous coating layer and the fibrous base material.

The binder optionally applied to the fibrous base material may be any of those conventionally used for synthetic leathers, for example, polyurethane elastomer, poly(vinyl chloride), natural rubber, synthetic rubber such as styrene-butadiene or acrylonitrile-butadiene copolymer, and mixture of these polymeric materials. The binder is applied in the form of a solution or emulsion or in other appropriate form to the sheet material composed mainly of fibers by impregnation, coating or other appropriate method. Generally, the amount of the binder is not more than 150% by weight based on the weight of the fibers.

The porous coating layer of a polymer is formed on at least one side of the fibrous base material. The polymer to be used includes polyurethane elastomer, acrylonitrilebutadiene copolymer, poly(vinyl chloride), polyamide and so on. Polyurethane elastomers wherein the percentage ratio of the weight of the isocyanate nitrogen to the total weight of the polyurethane elastomer (hereinafter referred to as N%) is 3 to 7% are preferred. In case the N% is less than 3%, the subsequent heat treatment will result in incomplete surface smoothening and thermal setting, and it is thus difficult to produce a leather-like material having a flat surface. On the other hand, if the N% is more than 7%, the bending crimp appearing on the resulting leather-like sheet material is occasionally of inferior quality, a low-graded synthetic leather thus being obtained. If necessary, such additives as filler, stabilizer, antistatic agent, pigment, dyestuff, sponging agent and coagulation regulator as well as another polymer that is compatible with the above-mentioned polymer in a solution, such as poly(vinyl chloride), poly (vinyl acetate), poly(vinyl formal), methacrylate resin, vinylidene chloride-acrylonitrile copolymer and vinyl chloridevinyl acetate copolymer, may be incorporated in the above-mentioned polymer.

A preferred method of forming the porous coating layer is the one wherein the fibrous base material is coated with a solution of a polymer such as said polyurethane elastomer and then immersed in a liquid which has an affinity with the solvent but not with the polymer, to cause coagulation of the polymer. Alternatively, it is also possible to form a porous coating layer as a film on a supporting sheet separately and, after peeling off the same from the supporting sheet, stick the porous film and the fibrous base material together.

In accordance with the invention, it is required that the ratio of the void space (voids) occurring in the porous coating layer should be at least 10%, preferably 30 to 80%. With a percentage of voids in the range of 30 to 80%, bending crimp more suggestive of a high quality appears on the resulting sheet material. The percentage of voids herein is calculated from the amounts and specific gravities of the constituents of said porous coating layer. Conveniently, however, the percentage of voids can be calculated from the apparent specific gravity of the porous coating layer and the specific gravity of the mass obtained by fusing and pressing the porous coating layer at a temperature above the softening points of the constituents thereof to make the same substantially nonporous.

Generally, the thickness of the porous coating layer is in the range of 50 microns to 1000 microns.

Prior to the thermal setting treatment, a nonporous layer A of a polymer is provided on the surface of the porous coating layer so that the heat treatment can be facilitated and the surface can be smoothened evenly and uniformly. Without such a polymer layer A, a uniformly flat surface cannot be obtained even under more severe thermal setting conditions, and inferior bending crimp and feeling will result.

Any of polymers conventionally used for the surface finishing of synthetic leathers may be used as the polymer for the layer A, such as polyurethane elastomer, poly(vinyl chloride), nylon and nitrocellulose. However, a polymeric material consisting mainly of a polyurethane elastomer is preferred, and a polymeric material consisting mainly of a polyurethane elastomer whose N% is 3 to 7% is most preferred in consideration of stability of the thermal setting and quality of the bending crimp. Polymers that can be used in combination with a polyurethane elastomer are, for instance, poly(vinyl chloride), methacrylate resin, nitrocellulose, poly(vinyl acetate), poly(vinyl formal), vinylidene chlorideacrylonitrile copolymer and vinyl chloride-vinyl acetate copolymer. Additives such as coloring agents and stabilizers may also be used in combination. The amounts of the additives should be such that they never affect adversely the subsequent thermal setting process. From the viewpoint of bending crimp, feeling, flexibility and other properties, the thickness of the polymer layer A is preferably 0.1 micron to 10 microns, more preferably 0.1 micron to 5 microns.

Addition of a coloring agent (pigment or dyestuff) to the polymer layer A is preferable, because it improves the tone and shade of color of the leather-like sheet material produced. Thus, in case the polymer layer A contains a coloring agent, as a result of synergistic effect of the polymer layer A and the polymer layer B which usually contains a coloring agent and is applied after the heat treatment step and also as a result of the thermal setting, a color having more depth, more vivid and more massive can be produced than mere overlapping of two coloring agents can produce.

Usually, the substrate is coated with the polymer layer A by applying a solution of the polymer containing said additives by spraying or gravure printing method, followed by drying.

The substrate having the polymer layer A is subjected to heat treatment for surface smoothening and thermal setting in accordance with the invention. The object of said heat treatment is to remove or erase various kinds of unevenness on the substrate surface without causing any substantial destruction of the porous structure in the substrate and to set the surface in a smoothened state. More detailedly, the surface provided with the polymer layer A and substantially dried is subjected continuously to a heat treatment-cooling procedure by means of a smooth surface the temperature of which is so controlled that it is 120° to 180° C. at the point of the substrate being pressed against said smooth surface and is 30° to 120° C. at the point of the substrate being peeled off therefrom, the temperature being allowed to lower gradually from the point of pressing to the point of peeling off and the temperature difference between the point of pressing and the point of peeling off being at least 20° C.

Generally, a metal plate or a metal roll is used as said smooth surface, and its surface may be coated with a special resin.

Since the heat treatment according to the invention has for its object smoothening of the superficial portion of the surface layer and thermal setting thereof in that state, it is not preferred to carry out said heat treatment-cooling procedure rapidly. Preferably, said procedure is carried out gradually over at least 30 seconds.

In a commercial production, the substrate surface is brought into contact with a flat, smooth surface maintained at a predetermined temperature, made to stick to the flat, smooth surface by a pressure of a backing roll, for example, then kept in the sticking state without pressure while the temperature is lowered gradually to a predetermined temperature, at which the substrate is peeled off. If a usual embossing roll is used, the pores within the coating layer of the substrate are deformed to a great extent, so that a sufficient flatness cannot be obtained and moreover the bending crimp of the leather-like sheet material produced is of an inferior quality. On the contrary, according to the method of the invention, only the superficial layer is deformed to a slight extent, so that the feeling and bending crimp are improved and at the same time a flat surface is obtained.

In case the temperature at the point of pressing is lower than 120° C., sticking or adhesion of the sheet to the metal plate or metallic roll is incomplete, and consequently a sufficiently flat surface cannot be produced. On the other hand, a higher temperature than 180° C. would cause deformation even of the pores within the coating layer, so that not only bending crimp is of an inferior quality but also embossing is difficult to perform if embossing is made later. If the temperature at the point of peeling off is lower than 30° C., excessively fast adhesion makes the peeling off difficult. If the temperature at the point of peeling off is above 120° C., the thermal setting of the substrate surface would be insufficient and a flat surface could not be obtained. A temperature difference not less than 20° C. is required between the point of pressing and the point of peeling off for sufficient thermal setting of the substrate surface and production of a flat surface.

Preferably, the metallic plate or metallic roll has a mirrorsmooth surface or an uneven pattern not more than 70 microns deep, since such facilitates uniform provision of the polymer layer B and at the same time greatly enhances the effects of the invention. With a smooth surface having an uneven pattern not more than 70 microns deep, a leather-like sheet material with a distinct, shallow grain is produced.

In a commercial production, and endless metallic plate is most preferred in consideration of cost of equipment, operating cost and easiness of operation. For example, a metallic belt having a mirror-smooth surface or an uneven pattern not more than 70 microns deep is put on a heating roll and a cooling roll, and the rolls are made to revolve at a predetermined rate so that the surface of the metallic belt is heated and cooled. Generally, the temperature of the smooth surface at the point of pressing is adjusted by means of steam or electricity, for example, and at the point of peeling off by means of water or air, for instance. In case the substrate sticks with difficulty to the metal surface, for example due to very great thickness or very heavy weight, or in case a sheet treated with a softening agent is subjected to the heat treatment, the substrate and the metallic surface are preheated before the pressing.

The thermally treated sheet is then provided with a nonporous polymer layer B.

Said polymer layer B is provided for the purpose of giving the leather-like sheet material produced a high-quality feeling as well as improving the appearance such as color and luster, the touch and the surface strength of the resulting leather-like sheet material. In addition, in case embossing is carried out after the application of said polymer layer B, manifestation of a beautiful, embossed pattern is facilitated by the presence of this polymer layer B. The polymer used in the polymer layer B may be the same one as is used as the polymer layer A. However, a polyurethane elastomer with an N% of 3 to 7 or a polymer mixture consisting of said polyurethane elastomer and a methacrylate resin is preferred in view of flexibility, surface strength and so on. In case a polymer mixture consisting of a polyurethane elastomer and a methacrylate resin is used, the amount of the methacrylate resin is preferably not more than 80% by weight based on the total amount of the polyurethane elastomer and the methacrylate resin in respect to flexibility.

In the case of normal products which are not dyed later on, it is preferred that the polymer layer B contains a coloring agent. The coloring agent may be either a pigment of a dyestuff. A metal complex dye is most preferred from the viewpoint of vividness of color and fastness to light. Although with a metal complex dye, the dye tends to migrate gradually from the layer B, this migration can be inhibited by the use of a polyurethane elastomer that contains a polyethyleneglycol in the soft segment. From the viewpoint of flexibility, the amount of the coloring agent to be used in the layer B is not more than 400% by weight, preferably not more than 250% by weight based on the weight of the polymer.

The polymer layer B may contain such additives as filler, stabilizer and luster adjusting agent, so long as they do not harm appearance, physical properties and other characteristics. In cases where the leather-like sheet material is subjected to a subsequent coloring treatment using a dye, it is preferred that the layer B contain an easily dyeable polymer or a layer of an easily dyeable polymer is applied on the layer B.

Similarly as in the case of the previously mentioned polymer layer A, the thickness of the polymer layer B is preferably within the range between 0.1 micron and 10 microns, more preferably between 0.1 micron and 5 microns, from the viewpoint of bending crimp, feeling and other properties.

Generally, for the formation of the polymer layer B, a solution of a polymer is applied to the heat-treated sheet by a spraying method or by a gravure printing method, followed by drying.

Preferably, the polymer layer B has a two layer structure. Thus, with a layer B consisting of a nonporous polyurethane elastomer layer (layer $B_1$) and a nonporous polyurethane elastomermethacrylate resin layer (layer $B_2$), the layer $B_1$ being in contact with the polymer layer A, the product has more improved appearance, touch, bending crimp and surface strength than the product with a layer B having a single layer structure.

It is preferred that the layer $B_1$ contain a coloring agent in an amount not more than 400% by weight, preferably not more than 250% by weight based on the polymer constituting the layer $B_1$. The amount of the methacrylate resin in the layer $B_2$ is not more than 80% by weight based on the total amount of the polyurethane elastomer and the methacrylate resin which constitute the layer $B_2$. Simiarly as in the case of the layer B mentioned above, the layers $B_1$ and $B_2$ may contain additives such as filler, stabilizer and luster adjusting agent. The thickness each of the layers $B_1$ and $B_2$ is preferably within the range between 0.05 micron and 5 microns. The layers $B_1$ and $B_2$ are applied, as in the case of the layer B, by spraying or by gravure printing.

If it is required to improve surface luster of the leather-like sheet material so produced or to give the surface of the sheet an embossed pattern, the surface of the leather-like sheet material having the layer B is pressed so that a mirror-like smoothness or an embossed pattern may be produced.

Most advantageously from the viewpoint of productivity, the embossing is carried out by the use of an embossing roll. Since a flat surface is already present, it is preferred to carry out the embossing under conditions milder than usual but just sufficient to give a desired embossed pattern.

Color adjustment or other treatment, such as luster adjusting, crumpling, dyeing and applying a polymer layer containing a pigment or a dyestuff, may be carried out, if necessary.

The leather-like sheet materials produced according to the method of the invention are excellent in respect to bending crimp, feeling and flatness in comparison with conventional products, and give an impression of high quality.

The method of the invention is especially effective for producing leather-like sheet materials having shallow grains not more than 50 microns deep, that is smooth leather-like sheet materials.

The following examples will elucidate the invention in more detail. In the examples, all the percentages are on a weight basis.

EXAMPLE 1

A nonwoven nylon fabric was impregnated with a solution comprising 15% of a polyurethane elastomer prepared from polybutylene adipate glycol, 1,4-butanediol and diphenylmethane-4,4'-diisocyanate and having a nitrogen content of 4.7%, 3% of a brown pigment, 3% of water and 79% of dimethylformamide. The same solution was applied to the impregnated fabric to such an extent that the solid matter on the fabric amounted to 80 grams per square meter, and the fabric was then treated with an aqueous solution containing 35% of dimethylformamide at 40° C. for 30 minutes, then deprived of the solvents and dried. The percentage of voids of the porous layer of the resulting porous substrate [I] amounted to 60%.

A solution composed of 10% of the above polyurethane elastomer, 28% of dimethylformamide, 38% of acetone and 24% of cyclohexanone was applied to said substrate to such an extent that the thickness of the solid matter contained in the solution amounted to 2 microns (polymer layer A), and the substrate was dried and subjected to heat treatment for 90 seconds by means of an endless metallic belt having a mirror-smooth surface, the temperature of the place of pressing being 150° C. and that of the place of peeling off 80° C. Said heat treatment was carried out in such a manner that the substrate was pressed against the metallic belt at the place of pressing at a gauge pressure of 2 kg/cm$^2$ by a rubber backing roll and then allowed to move with the belt without any pressure exerted thereon to the place of peeling off, where the substrate was released out of engagement with the belt. The surface flatness of the substrate so heat-treated was excellent.

The substrate was then coated with a solution consisting of 7% of a polyurethane elastomer prepared from polyethylene glycol, ethylene glycol and diphenylmethane-4,4'-diisocyanate and having a nitrogen content of 5.5%, 2% of Lanyl Brown 3R (a metal complex dye manufactured by Sumitomo Chemical Co., Ltd.), 18% of dimethylformamide, 42% of acetone and 31% of cyclohexanone, so that the coating has a thickness of 2 microns as the solid matter (polymer layer B). The resulting leather-like sheet material [A] showed excellent flatness and bending crimp, and had a deluxe feeling.

EXAMPLE FOR COMPARISON—1

Proceeding as in Example 1 except that the heat treatment was carried out by using an embossing roll with a mirror-smooth surface instead of the endless metallic belt used in Example 1, at a steam pressure of 6 kg/cm$^2$ (the roll temperature being 161° C.), a press pressure of 2 kg/cm$^2$ and a moving velocity of 5 meters per minute, a leather-like sheet material [B] was produced. It showed inferior flatness and bending crimp, and therefore was of low commercial value.

EXAMPLE FOR COMPARISON—2

The same substrate [I] as in Example 1 was given the same polymer layers A and B as in Example 1, and, without such a heat treatment as in Example 1, pressed in the same manner as in Example for Comparison—1 after the giving of polymer layer B. The leather-like sheet material [C] so produced showed considerably intense color unevenness and an inferior flatness.

EXAMPLE FOR COMPARISON—3

Proceeding as in Example 1 except that the application of the polymer layer A was omitted, a leather-like sheet material [D] was produced. It presented very intense color unevenness and artificial bending crimp, and was of no commercial value at all.

EXAMPLE FOR COMPARISON—4

The same substrate [I] as in Example 1 was directly subjected to the heat treatment of Example 1, and then given the layers A and B as used in Example 1. The resulting leather-like sheet material [E], similarly as the leather-like sheet material [D], presented very intense color unevenness, extremely bad flatness and artificial bending crimp, and therefore was of no commercial value at all.

EXAMPLE 2

Proceeding as in Example 1 except that the thickness each of the polymer layers A and B was 25 microns, a leather-like sheet material [F] was produced. It showed good color evenness, good flatness, but slightly inferior bending crimp. When the sheet material was bent, the impression, through insignificant, was such that it looks not so expensive.

EXAMPLE FOR COMPARISON—5

In the process of producing the leather-like sheet material [A], the application of the polymer layer B was omitted. The leather-like sheet material [G] so produced presented bending crimp of inferior quality and extremely violent color unevenness, although the flatness was very good. As a result, it was a commercially off-grade article.

The results of a subjective judgement on the appropriateness of the sheet materials [A] through [G] produced in the above examples and examples for comparison as leather-like sheet materials in respect to flatness, bending crimp and color evenness are shown in Table 1, wherein o denotes excellence, x badness and lack of commercial value, and Δ possession of commercial value but impression of cheap article.

Table 1

| Leather-like material | Flatness | Bending crimp | Color evenness | Subjective judgement |
|---|---|---|---|---|
| A | o | o | o | o |
| B | x | Δ | o | x |
| C | x | Δ | x | x |
| D | x | x | x | x |
| E | x | x | x | x |
| F | o | Δ | o | Δ – o |
| G | o | Δ | x | x |

EXAMPLE 3

A solution comprising 8% of a polyurethane elastomer prepared from polycarprolactone glycol, ethylene glycol and diphenylmethane-4,4'-diisocyanate and having a nitrogen content of 3.8%, 2% of poly(vinyl chloride), 1% of titanium dioxide and 89% of dimethylacetamide is so applied to a polyethylene sheet that the solid matter amounted to 60 grams per square meter of the sheet, the coated sheet is treated with an aqueous solution containing 20% of dimethylacetamide at 40° C. for 30 minutes. The solvents were then removed, and the film was peeled off from the polyethylene sheet and dried. The resulting, porous film was bound to a raised, woven polyester fabric by means of polyurethane elastomer of the cross linking type. The percentage of voids of the substrate [II] so produced was 73%. A solution comprising 6% of the same polyurethane elastomer as that used for the porous film of said substrate [II], 2% of poly(vinylchloride), 20% of dimethylacetamide, 42% of acetone and 30% of cyclohexanone was so applied to said substrate [II] that a thickness of 1.5 microns as solid matter was attained, then dried, and subjected to heat treatment under the same conditions and on the same equipment as employed for the leather-like sheet material [A] in Example 1 except that the temperature at the place of pressing and that at the place of peeling off were 140° C. and 40° C., respectively. A solution comprising 8% of the same polyurethane elastomer as that used for the coating layer of the substrate [II], 4% of an organic polycyclic pink pigment (manufactured by Dainichiseika Color & Chemicals Mfg Co., Ltd.), 18% of dimethylacetamide, 42% of acetone and 28% of cyclohexanone was then so applied to the heat-treated sheet that the layer had a thickness of 3 microns as solid matter, and the sheet was crumpled. The produced leatherlike sheet material [H] presented good flatness as well as good bending crimp, both giving a strong impression that the material was of a high quality.

EXAMPLE 4

A non woven fabric composed of composite fibers consisting of polyethylene and nylon was impregnated with a solution comprising 12% of a polyurethane elastomer prepared from polyethylene adipate glycol, diphenylmethane-4,4'-diisocyanate and ethanolamine and having an isocyanate nitrogen content of 4.8%, 1% of carbon black and 87% of dimethylacetamide. The same polymer solution was then so applied to the fabric that the solid matter amounted to 60 grams per square meter, the fabric was immersed in an aqueous solution containing 30% of dimethylacetamide at 45° C. for 30 minutes to coagulate the polymer, the polyethylene fiber portion was extracted with hot toluene, and the fabric was deprived of the solvent, dried, and treated with a softening agent. The produced substrate [III] had a porous layer with a percentage of voids of 65%.

A solution comprising 10% of the same polyurethane elastomer as above, 28% of dimethylformamide, 38% of acetone and 24% of cyclohexanone was so applied to said porous substrate that the solid matter attained a thickness of 2 microns (polymer layer A), and the substrate was dried and subjected to heat treatment under the same conditions and on the same equipment as in Example 1 except that the substrate and the metallic belt were preheated at 100° C. for a minute. Then a solution comprising 6% of the same polyurethane elastomer as above, 3% of poly(methyl methacrylate), 3% of Irgalan Black GBL (a metal complex dye produced by CibaGeigy AG), 17% of dimethylformamide, 30% of acetone and 41% of cyclohexanone was so applied to the surface layer of said substrate that a thickness of 3 microns was attained (polymer layer B), and the sheet was crumpled. The so-produced leatherlike sheet material [J] presented good flatness and good bending crimp, and could be made into ladies' shoes of very high commercial value.

EXAMPLE 5

Proceeding as in Example 1 except that the temperature at the place of pressing was 160° C. and that at the place of peeling off 96° C., a leather-like sheet material [K] was produced. This leather-like sheet material [K] was embossed to "zinama-grain" pattern by means of an embossing roll under milder conditions (a steam pressure of 3 kg/cm$^2$ (143° C.), a press pressure of 0.5 kg/cm$^2$, and a velocity of 7 meters per minute) than usual. The leather-like sheet material produced [L] showed good flatness, good bending crimp, but no color migration ("migration" herein means that the dye is leaving the layer B), gave an impression of a luxury, and had a beautifully embossed pattern.

EXAMPLE FOR COMPARISON—6

The same polymer layers A and B as used in Example 1 were applied successively to the substrate [I] produced in Example 1, but no heat treatment was carried out. The resulting sheet was subjected to embossing of the same pattern as in Example 5, but under usual, consequently stronger conditions (a steam pressure of 6 kg/cm$^2$ (161° C.), a press pressure of 2 kg/cm$^2$ and a velocity of 4 meters per minute) than in Example 5. The so-produced, leather-like sheet material [M] was inferior in flatness and color evenness, and therefore of less commercial value.

EXAMPLE 6

A leather-like sheet material [N] was produced in the same manner in the case of the leather-like sheet material [L] except that the polyurethane elastomer in the polymer layer B was replaced with the polyurethane elastomer used in the impregnation of the substrate [I]. The sheet material [N] was as good in flatness and bending crimp as the material [L], but exhibited a significant color migration in comparison with the material [L].

EXAMPLE FOR COMPARISON—7

A leather-like sheet material [P] was produced by proceeding in the same way as in Exmaple 5 except that the application of the polymer layer B and the heat treatment were reversed in order, that is the heat treatment was carried out after the application of the polymer layer B. The product [P] showed severe color unevenness, bad flatness and bad bending crimp.

EXAMPLE FOR COMPARISON—8

A leather-like sheet material [Q] was produced by proceeding as in Example 5 except that the application of the polymer layer B and the embossing were reversed in order, that is the polymer layer B was applied after the embossing. The product was inferior in flatness and bending crimp, and moreover showed color unevenness.

EXAMPLE FOR COMPARISON—9

A leather-like sheet material [R] was produced by proceeding as in Example 5 except that the application of the polymer layer A and the heat treatment were reversed in order, that is the polymer layer A was applied after the heat treatment. The product exhibited very bad flatness and violent color unevenness, and at the same time bad bending crimp.

EXAMPLE FOR COMPARISON—10

A leather-like sheet material [S] was produced by the same procedure as in Example 5 except that the application the polymer layer A was omitted. This product showed extremely bad flatness and bending crimp, and moreover intense unevenness of color.

The results of a subjective judgement on the appropriateness as leather-like sheet materials of the sheet materials produced in Examples 5 and 6 as well as in Examples for Comparison 6 to 10 from the viewpoint of flatness, bending crimp and color evenness are shown in Table 2. The criteria for judging are the same as for Table 1.

Table 2

| Leather-like sheet material | Flatness | Bending crimp | Color evenness | Subjective judgement |
|---|---|---|---|---|
| L | o | o | o | o |
| M | x | Δ | x | x |
| N | o | o | o | Δ – o |
| P | Δ | Δ | x | x |
| Q | Δ | Δ | Δ | Δ |
| R | x | Δ | x | x |
| S | x | x | x | x |

EXAMPLE 7

A leather-like sheet material [T] was produced by the same procedure as for the leather-like sheet material [L] in Example 5 except that, between the application of the polymer layer B and the embossing, a solution comprising 4% of the same polyurethane elastomer as that used in said polymer layer B, 4% of poly (methyl methacrylate), 20% of dimethylformamide, 42% of tetrahydrofuran and 30% of cyclohexanone was so applied that the solid matter had a thickness of 1.5 microns. The product [T] was not only good in flatness and bending crimp but also superior in luster, touch, color migration and surface strength to the leather-like sheet material [L], and was of high commercial value.

EXAMPLE 8

A solution comprising 6% of the same polyurethane elastomer as that used for the coating layer of the substrate [II] in Example 3, 2% of poly(vinyl chloride), 20% of dimethylacetamide, 42% of acetone and 30% of cyclohexanone was so applied to the substrate [II] that the solid matter in the solution had a thickness of 1.5 microns (polymer layer A), and the substrate was dried and then subjected to heat treatment under the same conditions and on the same equipment as in Example 1 except that the temperature was 145° C. at the place of pressing and 65° C. at the place of peeling off. To the substrae were applied first a solution comprising 8% of the same polyurethane elastomer as that used for the coating layer of said substrate [II], 4% of an organic polycyclic pink pigment (manufactured by Dainichiseika Color & Chemicals Mfg Co., Ltd.), 18% of dimethylacetamide, 42% of acetone and 28% of cyclohexanone to such an extent that the solid matter attained a thickness of 4 microns (polymer layer B) and then a solution comprising 7% of the same polyurethane elastomer as that used for the coating layer of the substrate [II], 16% of dimethylacetamide, 44% of acetone and 33% of cyclohexanone to such an extent that the solid matter attained a thickness of 1.5 microns (polymer layer B). The resulting sheet material was further embossed to a kip-tone pattern by means of an embossing roll under conditions (a steam pressure of 2 kg/cm$^2$ (134° C.), a press pressure of 0.7 kg/cm$^2$ and a velocity of 5 meters per minute) milder than usual, and finally crumpled. The leather-like sheet material [U] so produced was good in flatness and bending crimp. Its embossed pattern was beautiful, and it gave an impression of its being of a high quality.

EXAMPLE FOR COMPARISON—11

A leather-like sheet material [V] was produced by proceeding as in Example 8 except that the application of the polymer layer B was omitted. This sheet material [V] was not embossed sufficiently, since it lacked the polymer layer B. Its appearance was poor.

EXAMPLE FOR COMPARISON—12

A leather-like sheet material [W] was produced by applying the same polymer layer A as in Example 3 to the substrate [II] produced in Example 3, heat-treating the substrate as in Example 8, and, without application of the polymer layer B, subjecting the sheet to embossing under more severe conditions (a steam pressure of 8 kg/cm$^2$ (168° C.), a press pressure of 1.5 kg/cm$^2$ and a velocity of 3 meters per minute) in an attempt to produce the same embossed pattern as that on the leather-like sheet material [U], and then crumping the sheet. The sheet material [W] had an improved embossed pattern in comparison with the sheet material [V], but, when compared with the leather-like sheet material [U], the embossing was not sufficient. Moreover, due to the more severe embossing conditions, bending crimp of the surface was deteriorated.

EXAMPLE 9

A nonwoven fabric composed of mixed spun fibers consisting of polyethylene and nylon in a ratio of 1 to 1 and having an apparent specific gravity of 0.3 gram/cm$^3$ and a thickness of 2.0 mm was impregnated with a solution comprising 12% of a polyurethane elastomer prepared from polyethylene adipate glycol, diphenylmethane-4,4'-diisocyanate and ethanolamine and having an isocyanate nitrogen content of 4.8%, 4% of a brown pigment and 84% of dimethylacetamide. The same polymer solution was further so applied thereto that the solid matter amounted to 60 grams per square meter, the sheet was immersed in an aqueous solution containing 30% of dimethylacetamide at 45° C. for 30 minutes to coagulate the polymer, the polyethylene portion of the fibers was extracted with hot toluene, and the sheet was deprived of the solvents and dried. The resulting porous substrate [IV] had a percentage of voids of 65%.

An aqueous suspension containing 3% of a condensation product between polypropylene glycol and adipic acid (having a molecular weight of about 10,000) and 0.5% of [$C_{22}H_{45}CONHC_2H_4NHCOC_{23}H_{47}$]. HCl was applied to said porous substrate to such an extent that the solid matter amounted to 4%, and the substrate was dried at 140° C. for 5 minutes.

Subsequently a solution comprising 10% of the same polyurethane elastomer as that used for the porous substrate, 28% of dimethylformamide, 38% of acetone and 24% of cyclohexanone was so applied to said porous substrate that the solid matter had a thickness of 2 microns (polymer layer A), and the substrate was subjected to heat treatment under the same conditions and on the same equipment as for the leather-like sheet material [K] in Example 5 except that said substrate and the endless, metallic belt were preheated at 100° C. for a minute. Then, a solution comprising 5.5% of the same polyurethane elastomer as that used for the porous substrate, 1.5% of Lanyl Brown 3R (a metal complex dye produced by Sumitomo Chemical Co., Ltd.), 16% of dimethylformamide, 27% of acetone and 50% of cyclohexanone was applied to the surface layer of said substrate to a thickness of 3 microns (polymer layer $B_1$). Further, a solution comprising 4% of the same polyurethane elastomer as that used for the porous substrate, 4% of poly(methyl methacrylate), 20% of dimethylformamide, 30% of acetone and 42% of cyclohexanone was so applied to the surface of the substrate that the solid matter had a thickness of 1.5 microns (polymer layer $B_2$).

Embossing to a rough "zinama-grain" pattern was carried out by means of an embossing roll under conditions (a steam pressure of 1 kg/cm$^2$ (125° C.), a press pressure of 1 kg/cm$^2$ and a velocity of 4 meters per minute) milder than usual, followed by crumpling, to give a leather-like sheet material [X], which presented good flatness and good bending crimp, was very soft, had a beautiful embossed pattern, and could be made into men's shoes of very high commercial value.

What is claimed is:

1. A method for producing an improved leather-like sheet material which comprises providing a substrate having a porous coating layer with a nonporous layer A of a polymer, pressing the substrate against a smooth surface at a temperature of 120° to 180° C. with the layer A in contact with said smooth surface, the temperature of said smooth surface being so controlled that it lowers gradually from the point of pressing to the point of peeling off, the temperature at the point of peeling off being in the range of 30° to 120° C. and the temperature difference between the point of pressing and the point of peeling off being at least 20° C., subjecting the substrate surface continuously to smoothening and thermal setting under said temperature conditions, peeling off the substrate from said smooth surface, and providing the smoothened substrate with a nonporous layer B of a polymer.

2. A method as claimed in claim 1, wherein said substrate consists of a fibrous base material with a porous polyurethane elastomer contained therewithin, and a porous coating layer comprising a polyurethane elastomer.

3. A method as claimed in claim 1, wherein a polyurethane elastomer having an isocyanate nitrogen content of 3 to 7% by weight is used for said polymer layer A.

4. A method as claimed in claim 1, wherein a polyurethane elastomer having an isocyanate nitrogen content of 3 to 7% by weight or a mixture of said polyurethane elastomer and a methacrylate resin is used for said polymer layer B.

5. A method as claimed in claim 1, wherein said polymer layer B consists of a polymer layer (layer $B_1$) comprising a polyurethane elastomer and a coloring agent, and a polymer layer (layer $B_2$) comprising a polyurethane elastomer and a methacrylate resin.

6. A method as claimed in claim 1, wherein a flat, endless, metallic plate is used as an equipment for continuously smoothening and thermally setting the substrate surface.

7. A method for producing an improved leather-like sheet material which comprises providing a substrate having a porous coating layer with a nonporous layer A of a polymer, pressing the substrate against a smooth surface at a temperature of 120° to 180° C. with the layer A in contact with said smooth surface, the temperature of said smooth surface being so controlled that it lowers gradually from the point of pressing to the point of peeling off, the temperature at the point of peeling off being in the range of 30° to 120° C. and the temperature difference between the point of pressing and the point of peeling off being at least 20° C., subjecting the substrate surface continuously to smoothening and thermal setting under said temperature conditions, peeling off the substrate from said smooth surface, providing the smoothened substrate with a nonporous layer B of a polymer, and embossing the surface of the substrate.

8. A method as claimed in claim 7, wherein said substrate consists of a fibrous base material with a porous polyurethane elastomer contained therewithin, and a porous coating layer comprising a polyurethane elastomer.

9. A method as claimed in claim 7, wherein a polyurethane elastomer having an isocyanate nitrogen content of 3 to 7% by weight is used for said polymer layer A.

10. A method as claimed in claim 7, wherein a polyurethane elastomer having an isocyanate nitrogen content of 3 to 7% by weight or a mixture of said polyurethane elastomer and a methacrylate resin is used for said polymer layer B.

11. A method as claimed in claim 7, wherein said polymer layer B consists of a polymer layer (layer $B_1$) comprising a polyurethane elastomer and a coloring agent, and a polymer layer (layer $B_2$) comprising a polyurethane elastomer and a methacrylate resin.

12. A method as claimed in claim 7, wherein a flat, endless, metallic plate is used as equipment for continuously smoothening and thermally setting the substrate surface.

* * * * *